United States Patent [19]

Hikade

[11] Patent Number: 4,588,359

[45] Date of Patent: May 13, 1986

[54] COMPRESSOR CAPACITY CONTROL APPARATUS

[75] Inventor: Robert C. Hikade, Sussex, Wis.

[73] Assignee: Vilter Manufacturing Corporation, Milwaukee, Wis.

[21] Appl. No.: 685,848

[22] Filed: Dec. 24, 1984

[51] Int. Cl.[4] ..... F04B 49/02

[52] U.S. Cl. ..... 417/298; 417/299

[58] Field of Search ..... 417/298, 299; 92/128

[56] References Cited

U.S. PATENT DOCUMENTS

| | | | |
|---|---|---|---|
| 1,936,411 | 11/1933 | Schneider | 417/298 X |
| 2,155,236 | 4/1939 | Newell | 417/298 X |
| 3,295,422 | 1/1967 | Bostwick | 92/128 UX |
| 4,389,168 | 6/1983 | Yannascoli et al. | 417/298 X |
| 4,477,236 | 10/1984 | Elliott | 417/568 X |

FOREIGN PATENT DOCUMENTS

| | | | |
|---|---|---|---|
| 789886 | 1/1958 | United Kingdom | 417/298 |

*Primary Examiner*—Richard E. Gluck

*Attorney, Agent, or Firm*—James E. Nilles; Thomas F. Kirby

[57] ABSTRACT

A gas compressor has cylinders in which gas is compressed by pistons. Each cylinder has a suction valve and an exhaust valve to admit uncompressed gas and expel compressed gas. The suction valve includes a suction valve plate which repeatedly moves toward and away from the top end of the cylinder between closed and open positions, respectively. Apparatus to control compressor capacity includes an unloader mechanism to selectively prevent the suction valve plate moving to fully closed position to thereby unload the cylinder and reduce compressor capacity. The unloader mechanism comprises an unloader piston movable in an unloader cylinder in response to system conditions to move a linkage which determines the closure position of the suction valve plate. The linkage includes a pivotable lift arm biased toward a position which allows full closure of the suction valve plate and is movable by the unloader piston to another position which prevents full closure of the suction valve plate. The unloader piston, which merely rests on the lift arm and is relatively massive so as to reduce chatter caused by reciprocation of the suction valve plate, is accessible for removal and service of a piston ring thereon merely by removal of the cylinder cover.

2 Claims, 10 Drawing Figures

COMPRESSOR CAPACITY CONTROL APPARATUS

BACKGROUND OF THE INVENTION

1. Field of Use

This invention relates generally to apparatus for controlling the capacity of a gas compressor such as is used in a refrigeration system or the like.

In particular, it relates to an improved unloader piston construction and arrangement in such apparatus whereby the unloader piston rings can be more easily replaced.

2. Description of the Prior Art

Reciprocating type gas compressors employ cylinders in which gas is compressed by reciprocably movable pistons. Typically, a suction or gas intake port and an independently operable discharge port are provided at the upper end of each cylinder. The suction port is provided with a suction valve having fully closed and fully open positions. In some reciprocating compressors unloading means are provided to "unload" the compressor, as during start-up or during operation when the full compressing capacity of the compressor is not needed. This can be accomplished by making one or more of the cylinders active or inactive, as by preventing full reclosure of the suction valve after each gas intake stroke and thereby enabling some or all of the gas entering the cylinder to exit through the intake port before it is compressed. In one type of compressor the cylinder takes the form of a hollow cylindrical sleeve or liner which is rigidly mounted on the compressor frame or housing. A removable cover, which is also part of the compressor housing, overlies the top end of the cylinder. The suction valve comprises an axially movable annular valve plate located at upper end of the cylinder directly beneath the cover. In compressor operation, the valve plate is repeatedly axially shiftably movable toward and away from the upper end of the cylinder between closed and open positions. Opening motion of the valve plate results from gas pressure differentials between the inside of the cylinder (low) and high gas pressure at the suction port which raises the valve plate during a suction stroke of the piston.

Capacity control means are provided to effect an appropriate shift of the valve plate to the positions of full closure or full open of the suction valve to thereby unload or load, respectively, that cylinder. One prior art form of capacity control means generally comprises an upwardly biased annular lift ring which is disposed around the cylinder sleeve and which is connected to the annular valve plate by lift pins which effect an upward shift and repositioning of the valve plate when the lift ring is raised. The lift ring is raised and lowered by a yoke assembly which engages the underside of the lift ring. The yoke assembly includes a yoke plate which is biased upwardly by yoke springs and is movable downwardly by a fulcrum pin which is welded to the yoke plate and pivotally connected intermediate the ends of a pivotally mounted yoke lifting arm or lever. One end of the lifting arm is pivotally connected to a base plate which has a fixed location relative to the compressor frame. The other end of the lifting arm is pivotally connected by a removable pivot pin to the lower end of an unloader piston rod which has its other end connected to an unloader piston. The unloader piston is located in and axially movable in an unloader cylinder formed in the compressor frame directly beneath the aforementioned removable cover. The unloader piston is movable axially to actuate the yoke lifting arm in response to gas (or oil) pressure in the unloader cylinder; the gas (or oil) pressure being indicative or representative of system conditions requiring loading or unloading. The unloader piston has one or more piston rings which need to be periodically replaced. Heretofore, this was accomplished by removing the compressor housing cover, the safety head spring, the safety head yoke, the safety head, the cylinder, the piston and its connection rod and then removing a hand-hole cover plate on the side of the compressor housing to gain access to the unloader piston rod and its pin and to gain access to yoke assembly within the compressor housing. Then, it was necessary to remove the pivot pin which connects the lifting arm to the unloader piston rod, withdraw the unloader piston and its attached unloader piston rod from the unloader cylinder, replace the piston rings, and re-assemble the apparatus. Since the pivot pin which connects the lifting arm to the piston rod is relatively inaccessible and difficult to remove and reinstall, piston ring replacement is a difficult, time-consuming and costly procedure.

SUMMARY OF THE PRESENT INVENTION

In accordance with the present invention, there is provided a gas compressor for a refrigeration system which comprises a compressor frame or housing within which sleeve-like gas compression cylinders are rigidly mounted. A housing cover is removably attached to the compressor frame and overlies the compression cylinders. Each compression cylinder is provided with a suction valve which comprises an annular valve plate which is mounted for repetitive axial movement relative to the compression cylinder and controls entry of gas into the cylinder. The valve plate is adjustably positionable axially by means of an improved unloader apparatus in accordance with the invention between closed and open positions to thereby render the compressor cylinder active or inactive (i.e. loaded or unloaded by controlling the amount of gas compressed therein), depending on the amount of compressor capacity needed at any given time. The improved unloader apparatus includes an unloader mechanism which comprises a lift ring, lift pins, ring biasing springs, a yoke assembly including a base plate, a yoke plate movably attached to the base plate, a yoke lifting arm, yoke biasing springs, an unloader cylinder and an unloader piston. The yoke plate is movable up or down to effect corresponding adjusting positioning of the lift ring, the lift pins and the suction valve plate. The yoke plate is movable upwardly by the yoke biasing springs and downwardly by the yoke lifting arm. The yoke lifting arm is pivotally connected at one end to the base plate which rests on the compressor housing and is connected intermediate its ends to the yoke plate by a fulcrum rod. The other end of the yoke lifting arm is biased upwardly by the biasing springs acting on the yoke plate in the yoke assembly and is movable downwardly by the unloader piston. The unloader piston rests on and engages the lifting arm but is not pivotally attached or otherwise mechanically secured thereto. The unloader piston is slidably mounted in the unloader cylinder which is formed in the compressor housing and generally vertically disposed directly beneath the housing cover. The unloader piston is responsive to the pressure of gas in the unloader cylinder supplied from some part of the compressor or the refrigeration system, which pressure is a function of system conditions. Part of this gas (or some other fluid responsive to the gas pressure) is fed to the unloader cylinder through a metering valve and a controllable solenoid valve. The unloader piston, which has a replaceable piston ring assembly thereon, is accessible and removable for piston ring assembly replacement merely by removing the housing cover to expose the top of the unloader cylinder and the unloader piston therein and by withdrawing the unloader piston by removal means in the form of a threaded bore formed in the top end of the unloader piston thereinto which receives a bolt temporarily screwed thereinto. The removal means further comprise means to prevent piston rotation while the bolt is inserted or removed, such as an axially pin-receiving offset hole formed in the top end of the piston.

Compressor capacity control apparatus in accordance with the present invention offers several advantages over the prior art. For example, replacement of the piston ring assembly on the unloader piston is easily accomplished by removing a single cover plate from the compressor frame, axially withdrawing the unloader piston from the unloader cylinder, replacing the piston ring assembly, re-inserting the unloader piston, and replacing the cover. There is no need to gain access to the other interior portions of the compressor housing by removing other hand-hole covers and to remove a pivot pin which is employed in prior art apparatus to connect a piston rod for the unloader piston to the yoke lifter arm. This results in a reduction of down-time, avoidance of extra labor and saving of needless repair costs. Furthermore, elimination of a pivot pin for securing the lift arm to the unloader piston rod simplifies construction, reduces costs of manufacture and eliminates several points which are subject to friction, wear and possible malfunction. The unloader piston and the associated lifter arm are simpler in design and configuration than those in the prior art and are, therefore, easier and more economical to manufacture. Other objects and advantages will hereafter appear.

DRAWINGS

DESCRIPTION OF A PREFERRED EMBODIMENT

Figure 1:
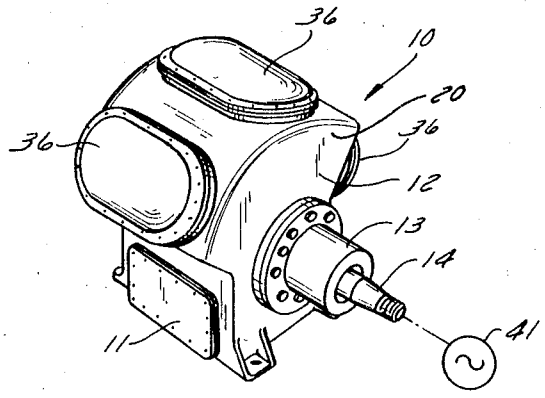
FIG. 1 is a perspective view of the outside of the housing of a gas compressor embodying the present invention.
Figure 2:
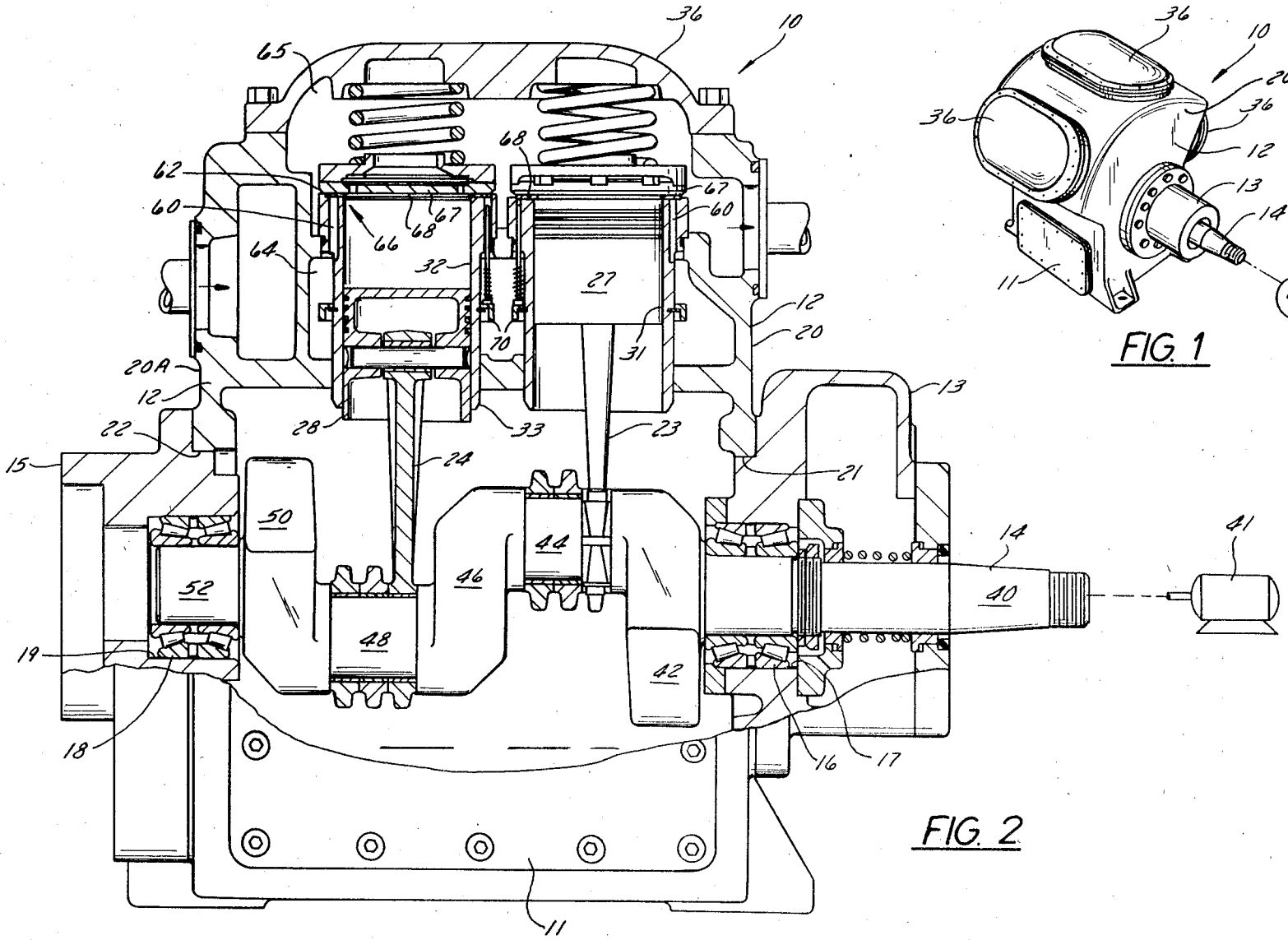
FIG. 2 is an enlarged cross-section view of the compressor of FIG. 1.

FIGS. 1 and 2 show portions of a reciprocating type six-cylinder gas compressor 10 such as is used to compress gas in a refrigeration system or the like. Compressor 10 comprises components including a one-piece cast iron or steel compressor frame or hollow housing 12, a one-piece cast crankshaft 14, and a main bearing assemblies 16 and 18 which are mounted in bores 17 and 19, respectively, in bearing support covers 13 and 15, respectively, which are mounted in holes 21 and 22 in the end walls 20 and 20A, respectively, of housing 12 and rotatably support crankshaft 14 in housing 12. Crankshaft 14 comprises a drive shaft 40 at one end, a first counterweight 42, a first crank pin 44, a center link or crank arm 46, a second crank pin 48, a second counterweight 50, and a pump shaft 52 at its other end for an oil pump (not shown). Each crank pin 44 and 48 is adapted to have three connecting rods associated therewith, but only connecting rods 23 and 24 are fully shown. The two connecting rods 23 and 24 are connected between crankshaft 14 and pistons 27 and 28, respectively, which are slidably mounted for reciprocating movement in cylinders 31 and 32, respectively, which take the form of sleeves mounted in housing 12. A removable cylinder cover 36 is provided on housing 12 for cylinders 31 and 32. In operation, crankshaft 14 is rotatably driven by an electric motor 41 connected to drive shaft 40 and imparts reciprocating motion to the two connecting rods 23 and 24 and their associated pistons 27 and 28, as well as to all other connecting rods and pistons driven by crankshaft 14. As will be understood, two or more compressors such as 10 could be ganged together end-to-end and driven by a single motor.

Figure 3:
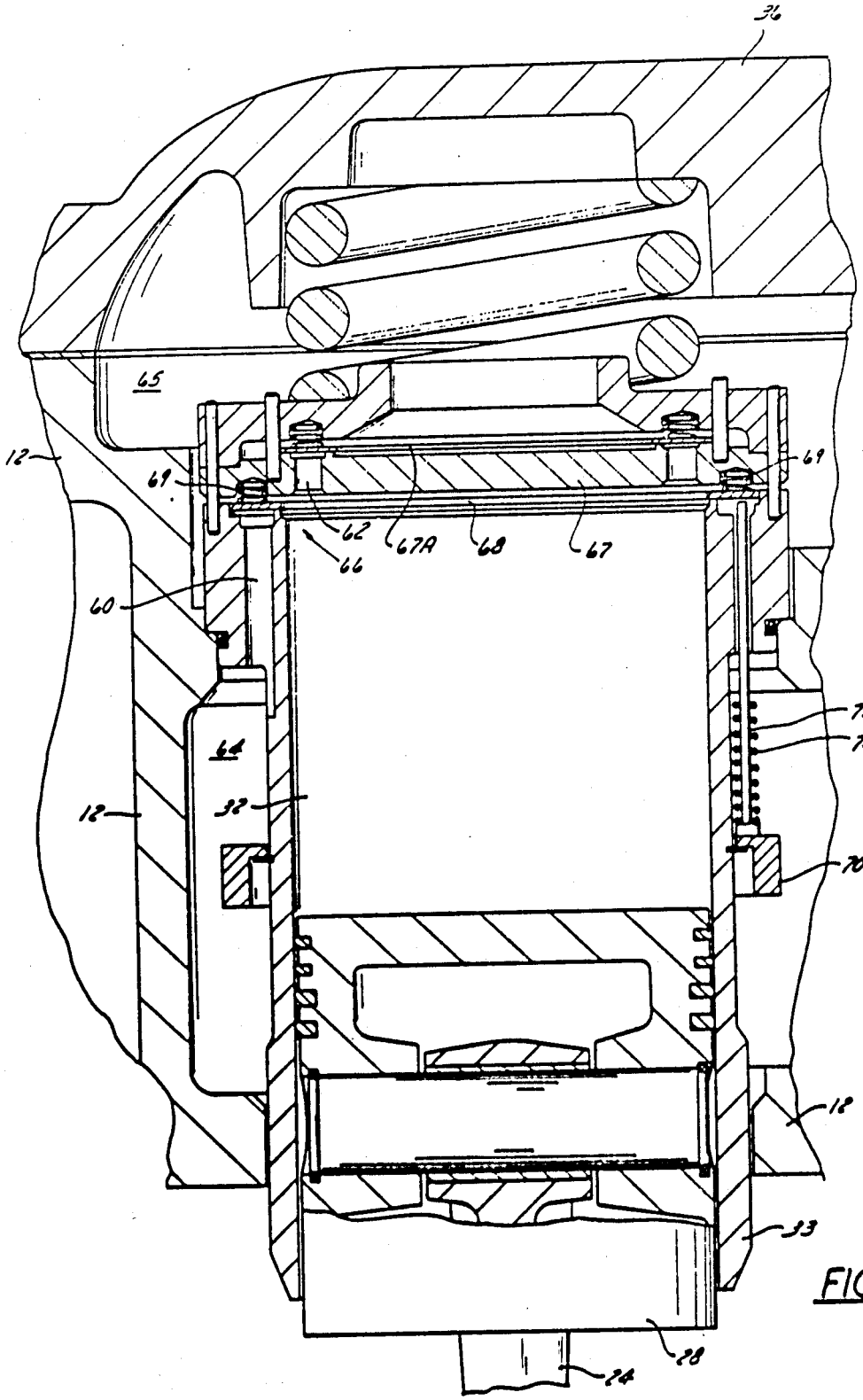
FIG. 3 is a greatly enlarged cross-section view of one of the compressor cylinders shown in FIG. 2 and showing the suction valve therefor.
Figure 4:
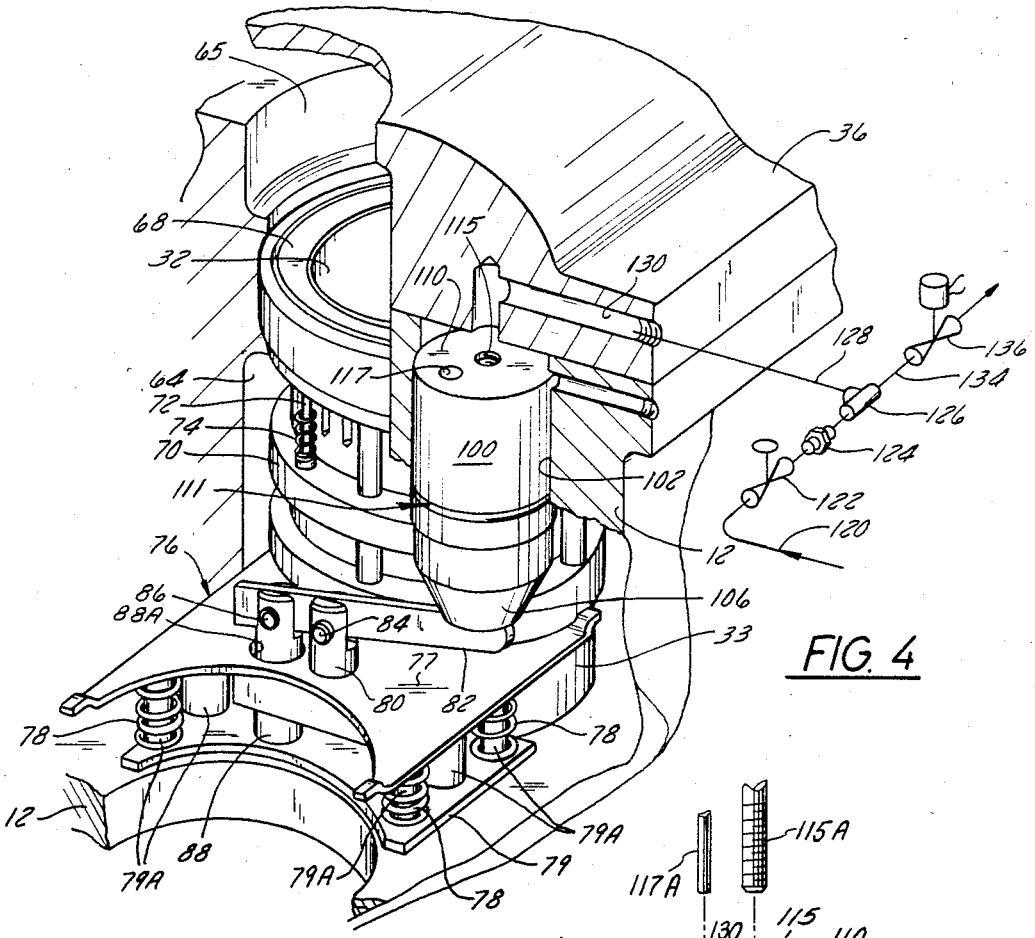
FIG. 4 is an enlarged perspective view with portions broken away of the compressor cylinder of FIG. 3 and of unloader means therefor in accordance with the present invention.

As FIGS. 1, 2 and 3 make clear, compressor 10 employs six cylinders, only 31 and 32 of which are shown in FIG. 2, in which gas is compressed by the respective reciprocably movable pistons. The six cylinders are radially arranged relative to the crankshaft 14 but are generally vertical. Cylinder 32, shown in FIGS. 2 and 3, is representative of all cylinders and, therefore, is the only one hereinafter described in detail. Referring to FIG. 3, cylinder 32 comprises a suction or gas intake port 60 and an independently operable exhaust port 62 which are provided at the upper end of the cylinder and communicate with suction and exhaust manifolds 64 and 65, respectively, in frame 12. The suction port 60 communicates through a suction valve 66 having fully closed and fully open positions with the interior of cylinder 32. Unloading means, hereafter described, are provided to "unload" the compressor 10, as during start-up or during operation when the full compressing capacity of the compressor is not needed. Unloading of cylinder 32 is accomplished by making cylinder 32 active or inactive, as by enabling or preventing, respectively, full reclosure of the suction valve 66 after each gas intake stroke of piston 28 by means of operation of the suction valve 66 and thereby enabling none or some, respectively, of the gas entering the cylinder to exit through suction valve 66 to the suction port 60 as it starts to be compressed within the cylinder. Cylinder 32 takes the form of a hollow cylindrical sleeve or liner 33 which is rigidly mounted on the compressor frame 12. Cover 36 overlies the top end of cylinder 32. As FIGS. 2, 3 and 4 show, the suction valve 66 comprises an axially movable annular suction valve plate or member 68 which is located at upper end of the cylinder 32 and is axially movable into and out of engagement with the upper end of the cylinder sleeve 33. FIG. 3 shows suction valve 66 in closed position wherein suction valve plate 68 engages the upper end of cylinder sleeve 33 and prevents gas from flowing from gas cylinder 32. Valve plate 68 is biased to closed position by a plurality of helical compression springs 69 disposed between suction valve plate 68 and a cylinder end plate 67. A discharge valve plate 67A is upwardly shiftable to upper gas discharge position near the end of a compression stroke of piston 28 due to high pressure in cylinder 32 to allow compressed gas to escape from cylinder 32 to discharge port 65. Suction valve plate 68 is movable axially upward toward open position in two ways: first, in the course of normal compressor operation when a gas pressure differential exists between the inside of cylinder 32 (low) and the suction port 60 (high) and, second, due to adjustment in the position of suction valve plate 68 effected by the capacity control means. The capacity control means, hereinafter described in detail, are provided to effect appropriate axial shifting up or down of the position of the suction valve plate 68 relative to the cylinder sleeve 33 to unload or load cylinder 32. As will be understood, in a one-cylinder compressor, unloading of the single cylinder unloads the compressor. In a multi-cylinder compressor, unloading of one or more cylinders would effect unloading of the compressor. Preferably, in a symmetrically arranged multi-stage compressor, such as compressor 10 disclosed herein, the capacity control means preferably effect unloading of all six cylinders in steps of two cylinders so as to maintain balanced operation. As FIGS. 4 and 7 best show, to reduce the number of parts and to reduce manufacturing costs, the capacity control means preferably comprises a common mechanism which operates to unload a pair of adjacent cylinders such as 31 and 32.

Figure 6:
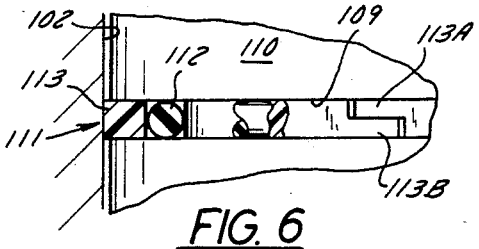
FIG. 6 is an enlarged side elevation view, partly in cross-section, of the piston ring assembly of the unloader piston of FIG. 5.
Figure 5:
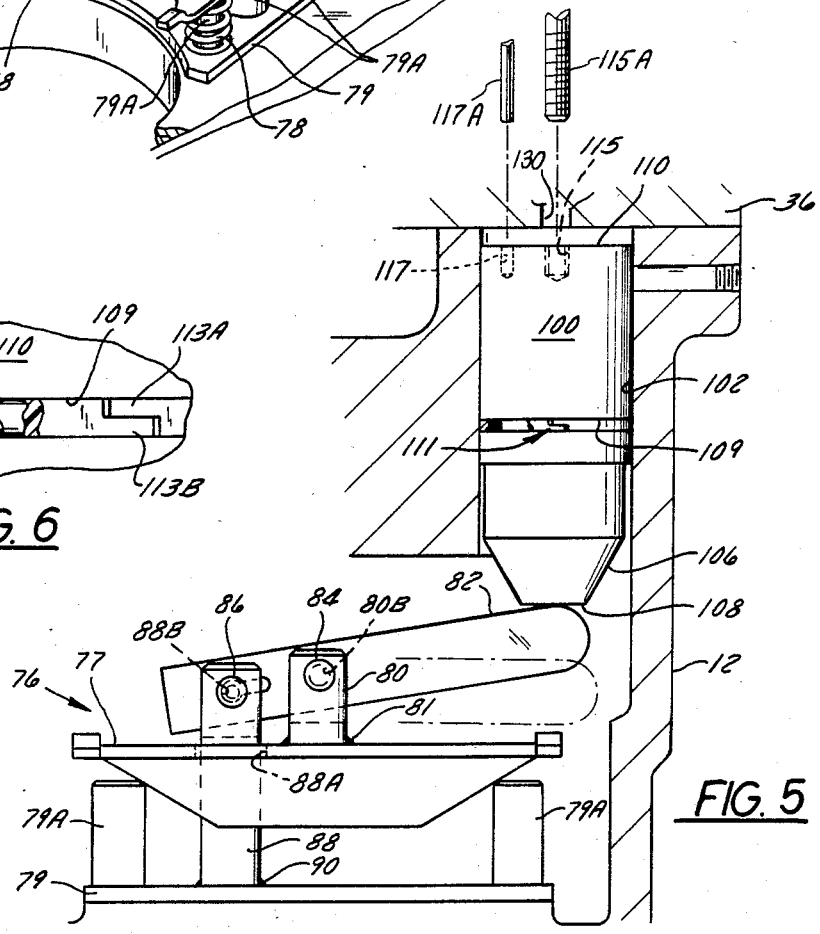
FIG. 5 is an enlarged side elevation view, partly in cross-section, of the yoke assembly, yoke lift arm, unloader cylinder and unloader piston of FIG. 4.
Figure 7:
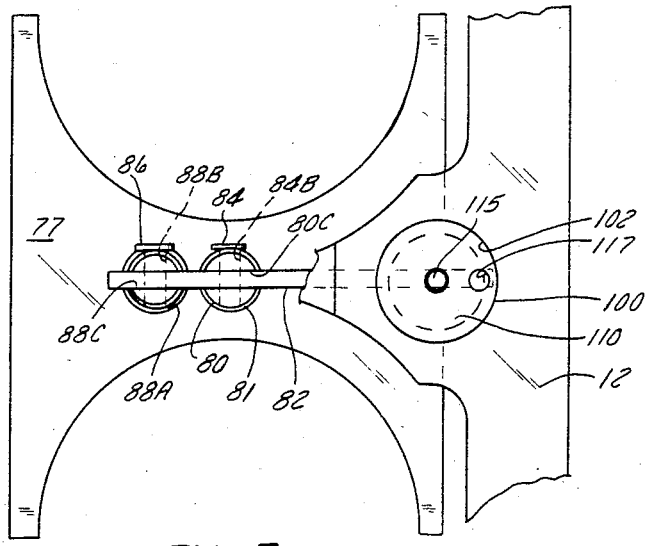
FIG. 7 is a top plan view of the yoke assembly and unloader cylinder and piston shown in FIG. 5.
Figure 8:
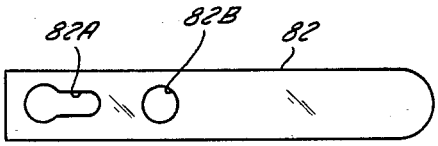
FIG. 8 is a side elevation view of the yoke lift arm shown in FIG. 5.
Figure 10:
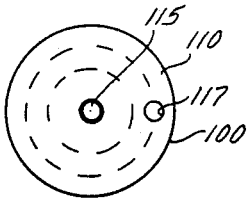
FIG. 10 is an elevation view of the upper end of the unloader piston shown in FIG. 9.
Figure 9:
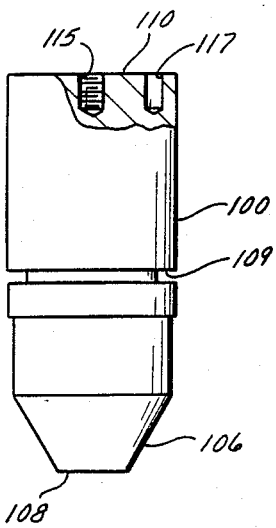
FIG. 9 is a side elevation view of the unloader piston shown in FIG. 5 with portions broken away to show the removal means.

Referring to FIGS. 3 through 10, the capacity control apparatus for cylinder 32 comprises an axially shiftable annular lift ring 70 which is disposed around the cylinder sleeve 33 and which is connected to operate the annular suction valve plate 68 by means of a plurality of lift pins 72 which rest on ring 70 and which effect upward (opening) movement of the valve plate 68 when the lift ring 70 is raised. The pins 72 (only one of which is shown) are located at intervals around the outside of cylinder sleeve 33. Lift ring springs 74 disposed around the pins 72 and between cylinder 32 and lift ring 70 and tend to bias the pins 72 downwardly against lift ring 70. The lift ring 70 is raised and lowered by a yoke assembly 76. As FIGS. 4, 5 and 7 show, yoke assembly 76 includes an upper plate 77 which engages the underside of the lift ring 70. Yoke assembly 76 further comprises the aforementioned upper plate 77, a lower base plate 79 (FIGS. 4 and 5) which has a fixed position relative to compressor frame 12, six stop pins 79A which are welded to the lower plate 79 and extend upwardly therefrom. Four helical compression springs 78 (FIG. 4) are disposed on four of the stop pins 79A between lower base plate 79 and upper plate 77 and serve as a biasing means to bias upper plate 77 upward. The stop pins 79A limit downward travel of the upper plate 77. Yoke assembly 76 further comprises a lever support rod 88 (FIGS. 4, 5 and 7) which is welded as at 90 to lower base plate 79 and extends through a hole 88A in upper plate 77. A fulcrum rod 80 is welded as at 81 to upper plate 77 and extends upwardly therefrom. The lever support rod 88 and the fulcrum rod 80 are provided with pin-receiving holes 88B and 80B, respectively, which receive a pivot pin 86 and a fulcrum pin 84, respectively. As FIG. 7 shows, the rods 80 and 88 are each provided with slots 80C and 88C through which the holes 80B and 88B, respectively, transversely extend and which accommodate a yoke lifting arm or lever 82 shown in FIGS. 4, 5, 7 and 8. Lifting arm 82 is pivotally secured at one end by pivot pin 86 to lever support rod 88. Pin 86 extends through an elongated hole 82A in lifting arm 82. Lifting arm 82 is also pivotally secured intermediate its ends by pivot pin 84 to fulcrum pin 84. Pin 84 extends through a round hole 82B in lifting arm 82. As FIGS. 4, 5 and 6 show, the upper side of the other end of lift arm 82 engages the lower end of an unloader piston 100, hereinafter described, which operates to effect downward movement (clockwise in FIG. 5) of the lift arm 82.

In operation, the upper plate 77 of yoke assembly 76 is biased upwardly by the yoke springs 78 and is movable downwardly by yoke lifting arm 82 acting through fulcrum rod 80. Yoke lifting arm 82 is moved downwardly by unloader piston 100. The four yoke springs 78 operate to bias yoke assembly plate 76 upwardly and plate 76 is movable downwardly against the spring bias by yoke lifting arm 82 acting through fulcrum rod 80 (but only as far as the stop pins 79A will allow).

As FIGS. 4, 5 and 7 show, the unloader piston 100 is located in and is axially movable in a generally vertically disposed unloader cylinder 102 formed in the compressor frame 12 directly beneath a portion of the aforementioned compressor housing cover 36 and is movable in response to fluid (gas or oil) pressure in the unloader cylinder. The fluid pressure is indicative of compressor system conditions requiring loading or unloading. More specifically, as FIG. 4 shows, gas is supplied from a high pressure line (not shown) which is understood to be connected to some stage of the compressor (preferably at the discharge of the second stage, if provided) of the refrigeration system, through a supply line 120, through a normally open stop valve 122 and a metering valve or connection 124 to a T-connection 126. From the T-connection 126 gas is supplied through a line 128 and through a passage 130 in housing cover 36 to the upper end of unloader cylinder 102. From the T-connection 126 gas is also supplied through a line 134 and through a controllable solenoid valve 136 to the suction chamber of a compressor stage. Operation of solenoid valve 136, in response to compressor or refrigeration system conditions, such as a range of high pressure to low pressure conditions, determines the amount of gas entering unloader cylinder 102. This, in turn, determines the movement and axial position of unloader piston 100 and the position of lift arm 82. Downward movement of piston 100 causes downward movement (clockwise in FIGS. 4 and 5) of lift arm 82, downward movement of fulcrum pin 80, downward movement of upper plate 77 (against the bias of the springs 78), downward movement of lift ring 70 (assisted by the bias of the springs 74), and downward movement of the lift pins 72 (in response to the bias of the springs 74). The position of the lift pins 72 determines the position of the suction plate 68 and, thus, the lift pins 72 control whether plate 68 can reach fully closed (loaded) or fully open (unloaded) position. This, therefore, determines whether the cylinder 32 is fully loaded or completely unloaded. Piston 100, being relatively heavy and being acted upon by gravity as well as gas pressure, tends to resist vibratory motion or chatter which might otherwise occur between it and lift arm 82 as the suction plate 68 reciprocates axially during compressor operation.

As FIGS. 4, 5 and 7 show, the unloader piston 100 takes the form of a solid steel cylinder having a flat upper end surface 110 and a conical lower end portion 106 which terminates in a flat lower end surface 108 which is hardened to reduce wear. The unloader piston 100 is relatively massive and heavy. The piston 100 is provided intermediate its ends with a circumferential groove 109 therearound for receiving a piston ring assembly 111 shown enlarged in FIG. 6. Piston ring assembly 111 comprises an annular one-piece continuous flexible resilient compressible inner O-ring 112 of circular cross-section and made of silicone rubber or the like and disposed in innermost position in groove 109. Piston ring assembly 111 also comprises an annular one-piece non-continuous flexible outer ring 113 of rectangular cross-section and made of an anti-friction material such as Teflon or Nylon plastic. Ring 113 is discontinuous and has overlapping end portions 113A and 113B (see FIGS. 5 and 6) which form an overlapping sealed joint. Outer ring 113 projects slightly beyond the cylindrical surface of piston 100 and is pressed inwardly against the bias of inner ring 112 to ensure a tight but low-friction fit against the wall of cylinder 102. The piston ring assembly 111 (or parts thereof) needs to be periodically replaced due to wear which occurs on the outer surface of outer ring 113.

As FIGS. 4, 5, 7, 9 and 10 show, removal means are provided to facilitate removal of unloader piston 100 from the upper end of unloader cylinder 102 when housing cover 36 is removed. Thus, the upper end face 110 of piston 100 is provided with a centrally located tapped or threaded bore or hole 115 in surface 110 which is adapted to temporarily receive a bolt, screw or threaded tool 115A, shown in FIG. 5, which is employed to assist in axial withdrawal of piston 100 from unloader cylinder 112 when cover 36 is removed. Hole 115 is centrally located on the axis of unloader piston 100 to prevent binding or "window-locking" of the piston in cylinder 102 as the piston is withdrawn. Anti-rotation means are provided to prevent rotation of piston 100 as the threaded tool 115A is screwed into or out of threaded hole 115. Thus, piston surface 110 is provided with a hole 117 offset from the piston axis for receiving another tool or pin 117A, shown in FIG. 5, which is employed to prevent rotation of piston 100. Tools 115A and 117A are insertable only if head 36 is removed.

Piston ring replacement is accomplished by removing the cover 36 to gain access to the upper end of the interior of the unloader cylinder 102 and the unloader piston 100, withdrawing the unloader piston 100 from the unloader cylinder 102 by inserting a removal tool 115A in hole 115 and the antirotation tool 117A in hole 117, replacing the piston ring assembly 111 of the piston 100, dropping unloader piston 100 back into unloader cylinder 112, and replacing cover 36. Unload piston 100 merely rests on lift arm 82. Since there is no mechanical connection therebetween other than this, there is no need to gain access to the interior of compressor housing 12 by removing lower access plate or cover 11 shown in FIG. 1 to remove or re-install the piston 100.

I claim:

1. In a gas compressor:

a compressor frame;

a hollow cylindrical compressor cylinder rigidly mounted on said compressor frame;

a movable suction valve member which is adjustably movable to control gas flow to said compressor cylinder to thereby control loading and unloading of the compressor cylinder;

and unloader means to effect movement of said suction valve member and comprising:

a lifting arm pivotally connected at a fixed location relative to said compressor frame and having a free end and being connected to effect movement of said suction valve member;

an unloader cylinder on said compressor frame;

and a cover plate overlying said compressor cylinder and said unloader cylinder and detachably connected to said frame;

an unloader piston having upper ad lower ends and having a piston ring therearound and slidably mounted in said unloader cylinder and resting on and bearing against said free end of said lifting arm for effecting movement of said lifting arm in response to fluid pressure in said unloader cylinder indicative of a load condition in said compressor, said unloader piston being accessible when said cover plate is detached from said frame to enable withdrawal of said unloader piston from said unloader cylinder.

2. In a gas compressor according to claim 1, removal means on said upper end of said unloader piston to facilitate axial withdrawal of said unloader piston from said unloader cylinder.

* * * * *